US006352259B1

(12) United States Patent
Israel

(10) Patent No.: US 6,352,259 B1
(45) Date of Patent: Mar. 5, 2002

(54) PET LOVER'S BOARD GAME

(76) Inventor: Richard N. Israel, 405 Michael Ct., Branchburg Township, Somerset County, NJ (US) 08876

( * ) Notice: Subject to any disclaimer, the term of this patent is extended or adjusted under 35 U.S.C. 154(b) by 0 days.

(21) Appl. No.: 09/659,635

(22) Filed: Sep. 12, 2000

(51) Int. Cl.[7] ..... A63F 3/00

(52) U.S. Cl. ..... 273/244; 273/256; 273/259; 273/277; 273/278

(58) Field of Search ..... 273/256, 243, 273/278, 244, 244.2, 236, 263, 259, 277; D19/75

(56) References Cited

U.S. PATENT DOCUMENTS

| | | | | | |
|---|---|---|---|---|---|
| 2,026,082 | A | | 12/1935 | Darrow | 273/184 |
| 3,656,757 | A | * | 4/1972 | Carroll | 273/134 D |
| 4,093,235 | A | * | 6/1978 | Barry | 273/254 |
| 4,140,319 | A | * | 2/1979 | Aycock et al. | 273/256 |
| 4,522,407 | A | * | 6/1985 | Hatherley | 273/256 |
| 4,657,259 | A | * | 4/1987 | Smith | |
| 4,824,117 | A | * | 4/1989 | Russel | |
| 4,856,788 | A | * | 8/1989 | Fischel | 273/256 |
| 5,042,816 | A | | 8/1991 | Davis et al. | 273/243 |
| 5,052,692 | A | * | 10/1991 | Gustafson | |
| 5,087,051 | A | * | 2/1992 | Lobue | |
| 5,120,066 | A | | 6/1992 | Cohen | 273/258 |
| 5,478,086 | A | * | 12/1995 | Aylett | 273/243 |
| 5,810,359 | A | * | 9/1998 | Wilkins et al. | 273/256 |

* cited by examiner

*Primary Examiner*—Stephen Blau
(74) *Attorney, Agent, or Firm*—Kenneth P. Glynn, Esq.

(57) ABSTRACT

The present invention is a pet lover's board game. It includes a playing board having a predetermined continuous path with spaces for movement of pieces therealong in accordance with rules. The playing board has marked breed spaces designating a specified breed of animal selected from cats, dogs, birds, horses and combinations thereof which have specified costs to own and a landing fee value. The board also has marked action spaces and marked event spaces. There is a random movement mechanism for randomly determining numbers of spaces to be moved by players in accordance with the rules, a set of pet ownership papers for the marked breed spaces provided to a player in exchange for payment of play money, and a set of event cards. Play money is used to make purchases, pay fines and pay landing fees. In preferred embodiments, houses and macro-houses may be purchased to enhance values and increase landing fees.

9 Claims, 7 Drawing Sheets

PET LOVER'S BOARD GAME

BACKGROUND OF THE INVENTION

1. Field of the Invention

The present invention relates to board games involving chance and skill. The board games are for pet lover's and are based on movement of pieces along a path with spaces which dictate play activity.

2. Information Disclosure Statement

The following patents are representative of board games:

U.S. Pat. No. 2,026,082 issued to Charles E. Darrow describes a board game apparatus commonly known as "Monopoly", which involves the use of a game board, dice, moveable pieces, houses, hotels, deeds, chance cards, opportunity cards, play money and rules.

U.S. Pat. No. 5,042,816 issued to Tracy L. Davis, et. al., is directed toward an educational and entertaining game that challenged the players knowledge of the Bible. The game is played by rolling a die and moving a game piece the appropriate number of spaces. Each gameboard space has an instruction thereon, that tells-the player what to do. The objective of the game is to acquire a predetermined number of points before your competitors. Points are gained by landing on an appropriate gameboard space which indicates a point reward for the correct answer to a Bible question. The gameboard spaces are so varied as to provide multiple options. Three sources of Bible questions exist depending on the gameboard space encountered. Additionally, gameboard spaces are randomly positioned through out the gameboard that cause the players to surrender points to the bank or other players. Success in the game is dependent upon knowledge of the writings contained within the Bible. Answers to the various questions are provided, but Bible citations are also included so that the-answer can be directly obtained from the Bible. Pathways between sections of the gameboard exist that may acquire a player to answer a specialized area of Bible based trivia. The difficulty and pace of the game are so designed as to challenge a player into learning all aspects of the Bible while having fun and interaction with other players.

U.S. Pat. No. 5,120,066 issued to Jack L. Cohen is directed toward an educational game apparatus which test's the player's ability to match a key word or key symbol to one or more subwords or sub-symbols. The key and list of possible answers are provided on cards., where the correct answer to the match is noted on the card back. Correct answers by a player translate into moves for the player's pieces around the continuous playing path of the game board. To win the game, a player must land each of his playing pieces on individually lettered spaces of the playing path to spell out the name of the game (i.e., T, H, E, S, A, U, R, U, S). Players have the opportunity during the game to increase the number of moves awarded them by gambling on the correctness of their answers. Special rules for game play arise when a player lands on a space already occupied by an opponent.

Notwithstanding the above prior art, there are no teachings or suggestions that would render the present invention anticipated or obvious.

SUMMARY OF THE INVENTION

The present invention is a pet lover's board game.

It includes a playing board having a predetermined continuous path with spaces for movement of pieces therealong in accordance with rules. The playing board may be square, rectangular, triangular, circular or any other shape, and may be flat or three dimensional (have topography). The playing board includes:

(i) marked breed spaces designating a specified breed of animal selected from cats, dogs, birds, horses and combinations thereof, said breed spaces identifying its specified breed by name, pictorial representation or combinations thereof, and has a specified cost to own value and a landing fee value;

(ii) marked action spaces, each designated so as to require a specified action of a player when a piece lands thereon. These may preferably be located at corners and may require a player to pay a fee, collect a fee, advance along the path of spaces, or wait a turn or even move backward; and, (iii) marked event spaces, each designated so as to represent an event which may initiate a payment or other event of a player when a piece lands thereon. In preferred embodiments, the playing board also includes:

(iv) marked animal-related expense facility spaces selected from the group consisting of boarding, grooming, feeding, taxing, licensing and combinations thereof.

Also included in the board game is one or more random movement means for randomly determining numbers of spaces to be moved by players in accordance with rules. These may be a die, dice, spinner, electronic device or other known random movement directive mechanism. There is also a set of pet ownership papers for marked breed spaces provided to a player in exchange for payment of play money if a player qualifies to purchase and elects to purchase in accordance with rules.

There is a set of event cards corresponding to at least one marked event space to be read and acted upon by a player when a piece lands on a corresponding event space. For example, opportunity cards or chance cards may be used. Opportunity cards would typically be positive events and chance cards could be either positive or negative events.

There are also a plurality of different icon pieces for use by a plurality of players. There may be items of the same shape but different colors, items of different shapes, or items with some other unique identifying quality. They may be in the shape of animals or items relating thereto.

Play money in predetermined denominations is also included. These would be bills such as $5, $10, $100, $500, $1000, in sufficient numbers to avoid log jams in the game play, i.e. to avoid running out of change for purchases, fines, etc.

Rules define use of the aforesaid by order of play, use of the random movement means, movement of pieces, acquisition of ownership papers, sale of ownership papers, action space play, event space play, use of event cards, payments of landing fees, and how games may be won or lost.

In preferred embodiments, the event spaces include at least one event space requiring a player to take an event card and act upon it when that player's piece lands upon it. Thus, the event cards are hidden and turned down before being taken and the player designate must take from the top of the deck. In most preferred embodiments there are at least two different event spaces, and two different collections of event cards, and each of the two different event spaces require a player to take and act upon an event card from a specific one of the two or different collections of event cards, e.g. opportunity cars and chance cards described above.

In other preferred embodiments of the present invention pet lover's board game there is also a plurality of animal housing unit structures available for purchase to players owning marked breed spaces wherein when other players having a piece land on a marked breed space with at least one animal housing unit, they will pay increased landing fees in relationship to the number of animal housing units on that space landed upon. Also included may be a plurality of macro-animal housing unit structures for purchase or conversion, being equal or greater in value to a specified number of animal housing unit structures and requiring a greater landing fee. They could be converted by turning a specified number of animal housing unit structures. The animal housing unit structures may be shaped and/or named as cat beds, dog houses, horse stalls, horse barns, bird cages and combinations thereof, or any other shape or name designation as the designer may devise.

Typically, the set of ownership papers are individual cards corresponding to individual marked board spaces and include breed identification, cost of ownership and landing fees. They may be referred to as Pedigree papers or otherwise.

In one preferred embodiment, the pet lover's board game of the present invention has marked breed spaces which are-dog breed spaces and the game is a dog lover's board game. In this case, a play money holding tray may have a topographical shape of a dog bone. In another preferred embodiment, the marked breed spaces are cat breed spaces and the game is a cat lover's board game.

The pet lover's board game of claim 16 wherein said board game further comprises:

(1) a set of animal-related expense facility ownership papers for at least a portion of the animal-related expense facility spaces, and those have a specified cost to own value and a landing fee value. They may be food stores, bakeries, grooming facilities, vets, boarding facilities, training facilities, walking facilities, etc.

BRIEF DESCRIPTION OF THE DRAWINGS

The present invention should be more fully understood when the specification herein is taken in conjunction with the drawings appended hereto, wherein.

DETAILED DESCRIPTION OF THE PRESENT INVENTION

Figure 1A:
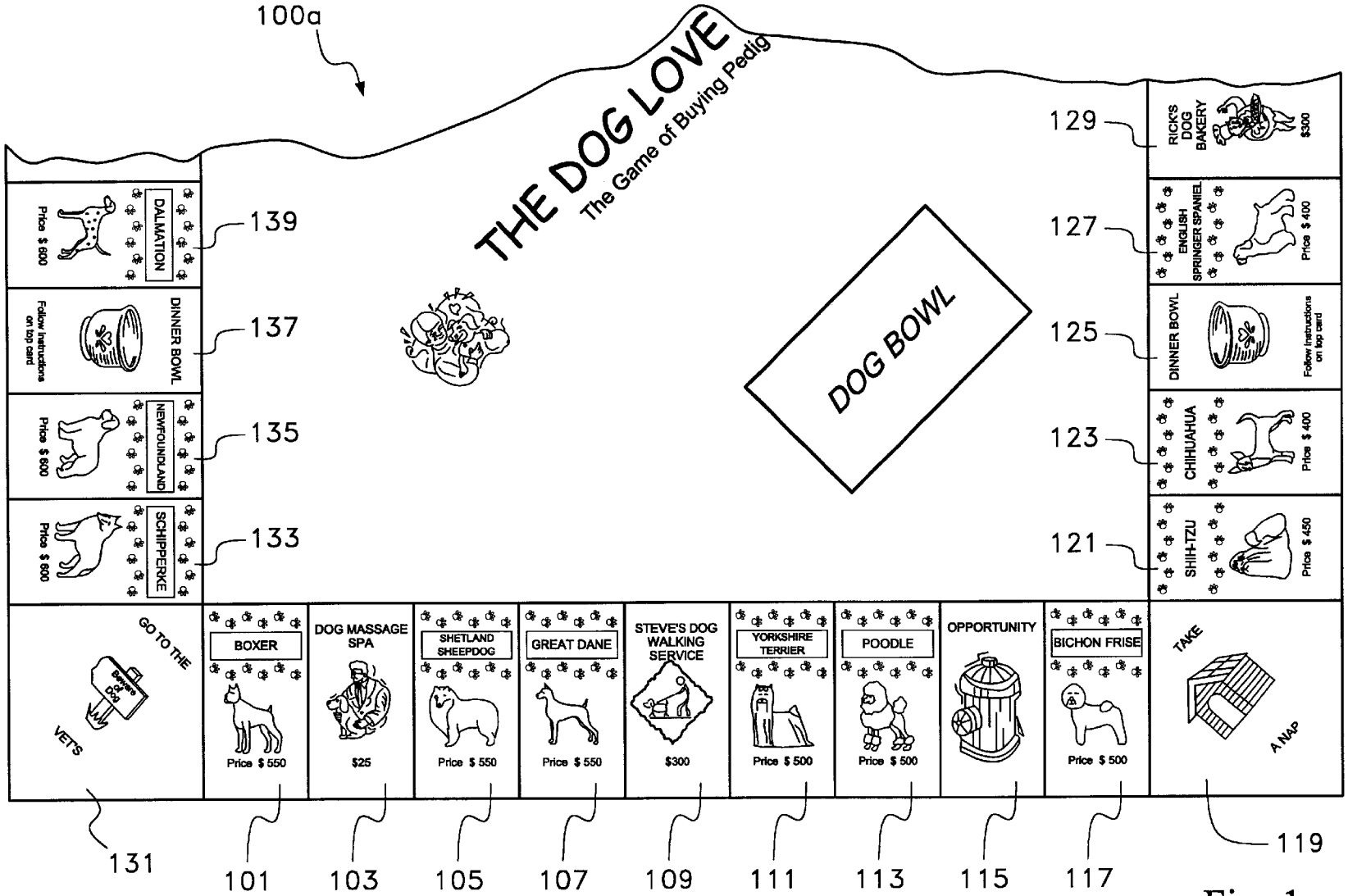
FIGS. 1*a* and 1*b* illustrate the bottom portion and the top portion of a playing board and one embodiment of a present invention Pet Lover's Board Game involving dog breeds.
Figure 1B:
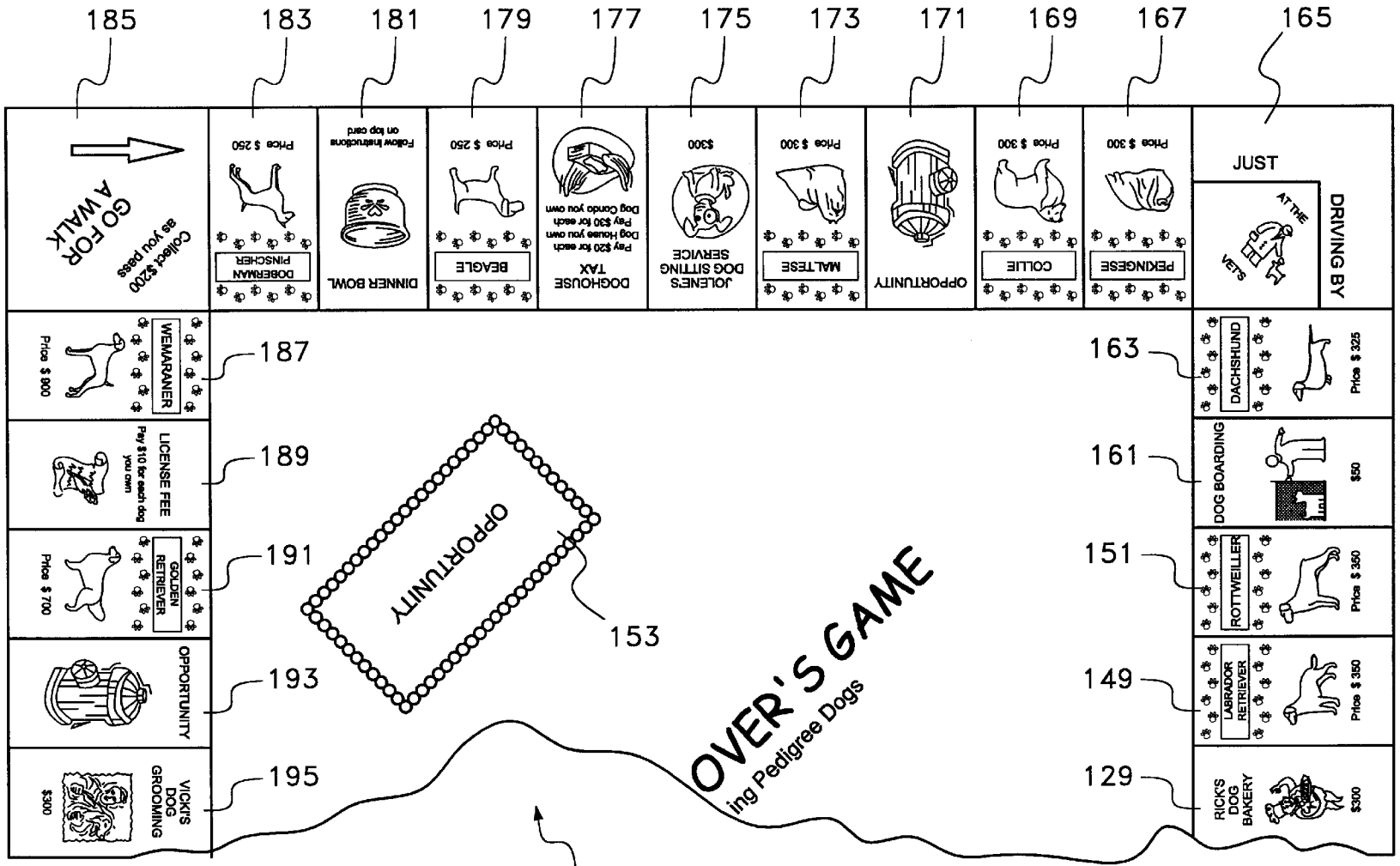

FIGS. 1*a* and 1*b* show approximately lower half and upper half portions of the playing board, 100*a* and 100*b*, respectively. Referring to the board "100" hereinafter shall mean the combined views of board portions 100*a* of FIG. 1*a* and board portions 100*b* of FIG. 1*b*.

Thus board 100 includes a continuous path of spaces, in this case, around four sides of a square board. These are marked breed spaces 101, 105, 107, 111, 113, 117, 121, 123, 127, 149, 151, 163, 167, 169, 173, 179, 183, 187, and 191. These have pictorial representations of specific breeds of dogs, the dog genre or name, and a price for "purchasing" ownership papers, e.g. Pedigree papers shown in subsequent figures. There are also action spaces, such as corner space 119, 131, 165, and 185. These spaces require the player, when landing thereupon, to take some action e.g. at space 131 to go to the vet's (diagonally across to space 165) or at space 119 to take a nap (lose a turn) or collect $200 at space 185. Other action variations may include requirements for the player to pay penalties and/or give up landing fees, ownerships or lose moves.

Event spaces are included on board 100, such as spaces 103 (a dog massage spa requiring a player to pay $25 landing fee), 109 (Steve's walking service with a landing fee of $300), space 115 (an opportunity space requiring a player to take an opportunity card from an opportunity deck which would be placed atop box 153), space 125 (a bowl space requiring a player to take a bowl card which would come from a deck placed atop square 143), spaces 129 (Rick's dog bakery with a landing fee of $300), spaces 161, 171, 175, 177, 181, 189, 193 and 195. In different variations of the game, none, some, or all of these event spaces may be purchasable by the first player to land thereon who elects to so purchase.

There is also a title 141 on board 100, in this case, "The Dog Lover's Game".

Figure 2:
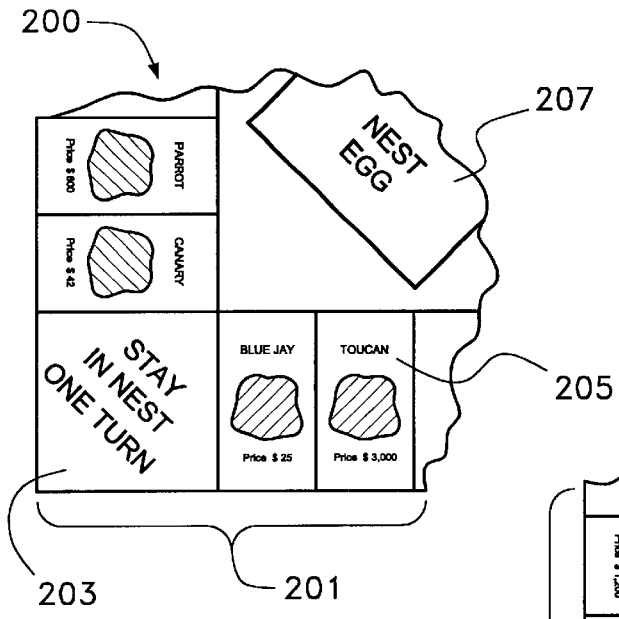
FIGS. 2, 3 and 4 respectively illustrate present invention playing board partial views having a bird theme, a horse theme, and a cat theme.

FIG. 2 shows a partial view of a corner of an alternative playing board for a present invention pet lover's board game having a bird theme. This board, as well as boards described below in conjunction with FIGS. 3 and 4 would have marked breed spaces, event spaces and action spaces. In FIG. 2, along path portion 201 is space 203 which would require a player to lose a turn, as well as breed spaces such as 205. Opportunity card box 207 on board 200 is referred to as a "Nest Egg".

Figure 3:
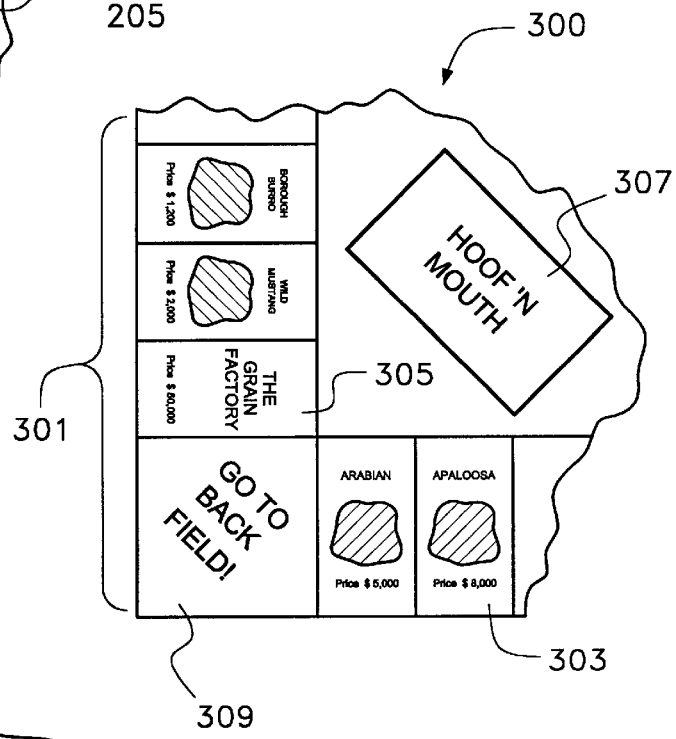
Figure 4:
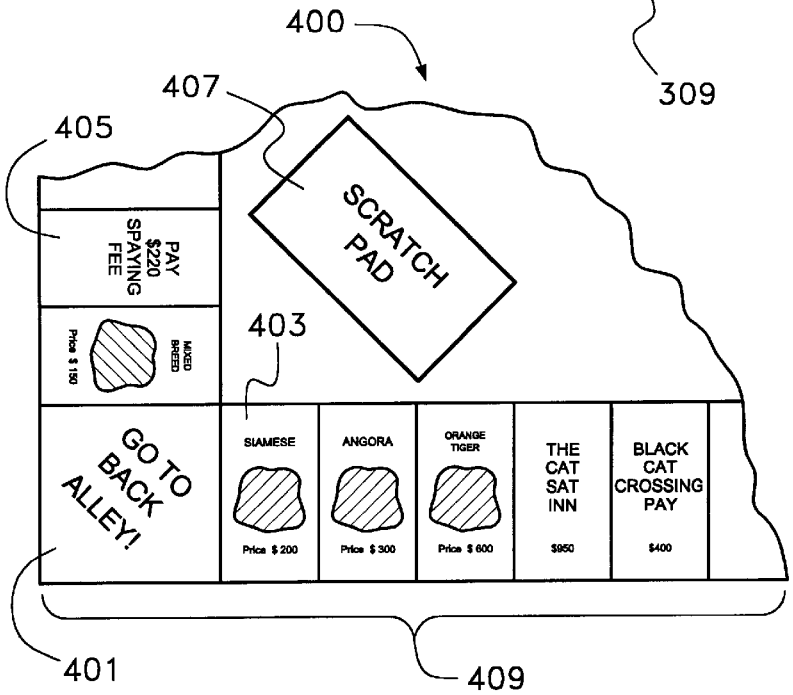

FIGS. 3 and 4 respectively similarly show partial views of present invention playing boards 300 and 400 directed respectively to horse and cat themes. In FIG. 3 a path is represented by path portion 301 which includes spaces 305 and 309. Space 305 is an animal related business, in this case a supply house called "The Grain Factory" which may be purchased for $50,000 and will command very high landing fees. Space 303 represents a typical breed space and box 307 is marked for a stack of "Hoof 'n Mouth" cards which would be a deck of chance cards.

FIG. 4 has a cat playing board 400 which include spaces 401, 403 and 405 as well as a "Scratch Pad" opportunity deck location. Space group 409 is typical of the possibilities and space 403 illustrates a breed space. Corner space 401 requires the player to move backward and event space 405 requires the payment of a $220.00 spaying fee.

Figure 5B:
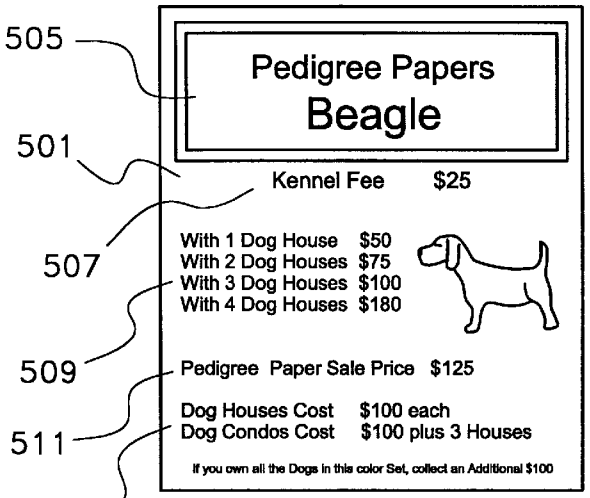
FIGS. 5*a* and 5*b* show front and back views of ownership papers in the form of Pedigree papers which may be used in the FIGS. 1*a* and 1*b* embodiment of the present invention.
Figure 5A:
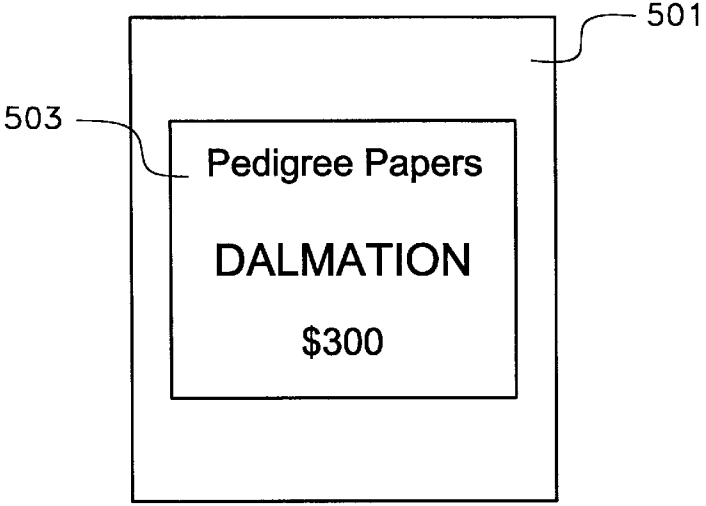

FIGS. 5*a* and 5*b* show the front and back sides of ownership documents, here referred to as Pedigree papers 501. Front side 503 states what it is, states the breed and the price. Backside. 505 included a title block, a landing fee 507 (here "Kennel Fee" for $25 and increased landing fees 509 based on the number of dog houses owned or whether a condo is owned. In this particular game, the dog condo is a macro-structure which includes 3 or 4 dog houses) There is also a paper sale price 511 and purchase costs 513 for dog houses and condos.

Figure 6B:
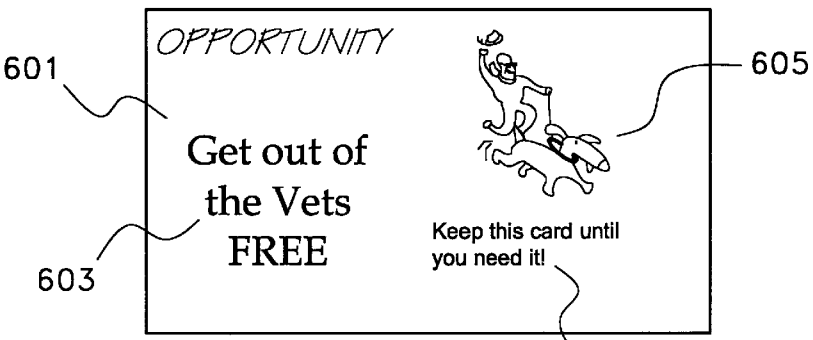
FIGS. 6*a* and 6*b* show front and back views of an opportunity card and FIGS. 7*a* and 7*b* show front and back views of a chance card useful in present invention board games.
Figure 6A:
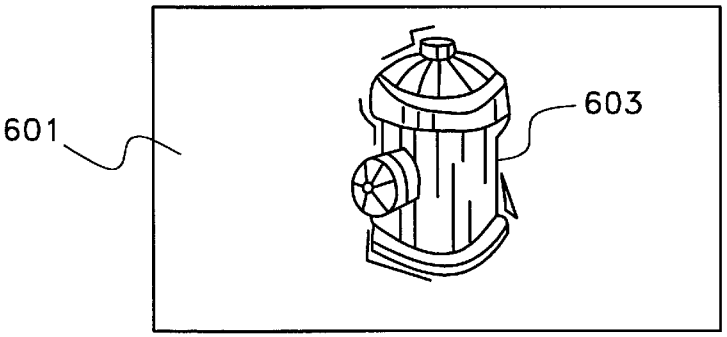

FIGS. 6*a* and 6*b* show front and back views of an opportunity card 601, which includes a fire hydrant 603, instructions 603 and 607 and a happy guy stylized with his dog 605.

Figure 7A:
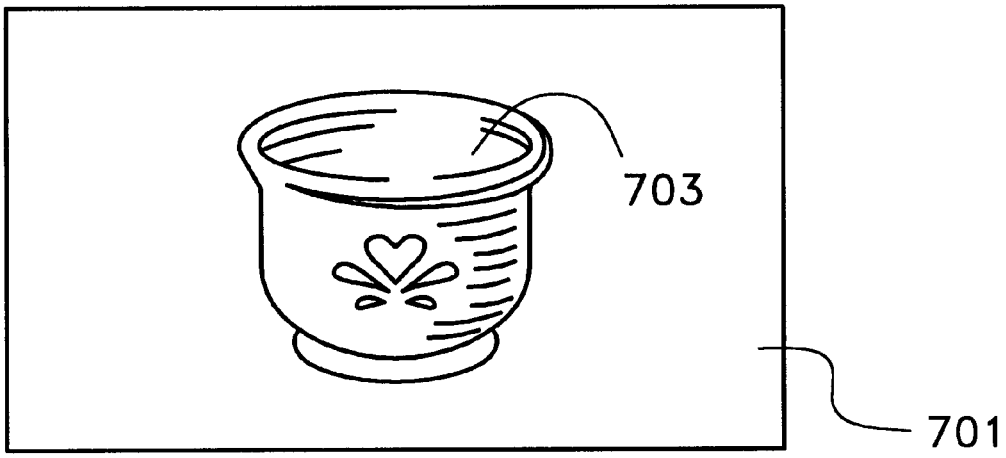
Figure 7B:
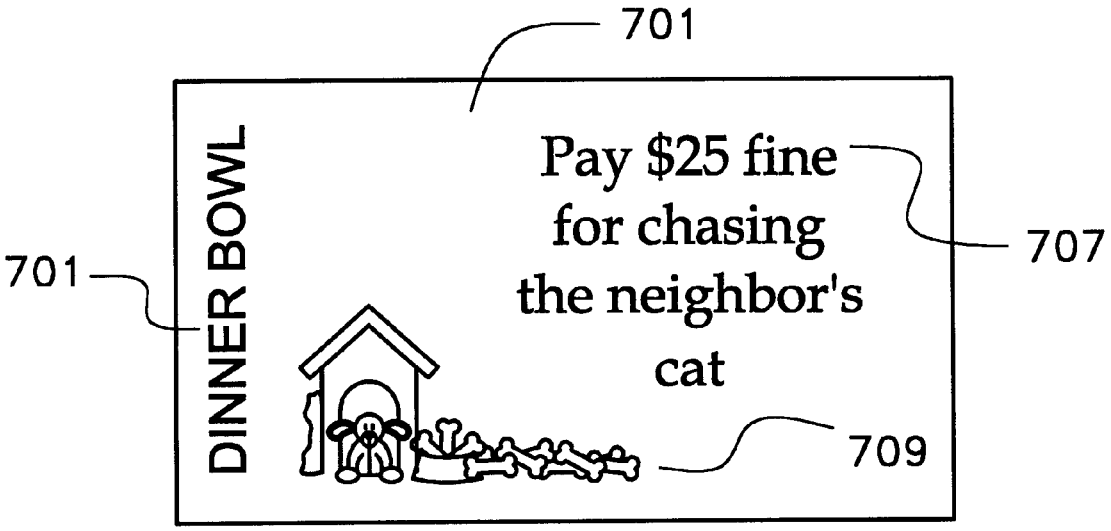

FIGS. 7*a* and 7*b* show front and back views of chance card 701 referred to as dinner bowl 705 which includes a stylized bowl 703, a pictorial illustration 709 and instructions 707.

Figure 8:
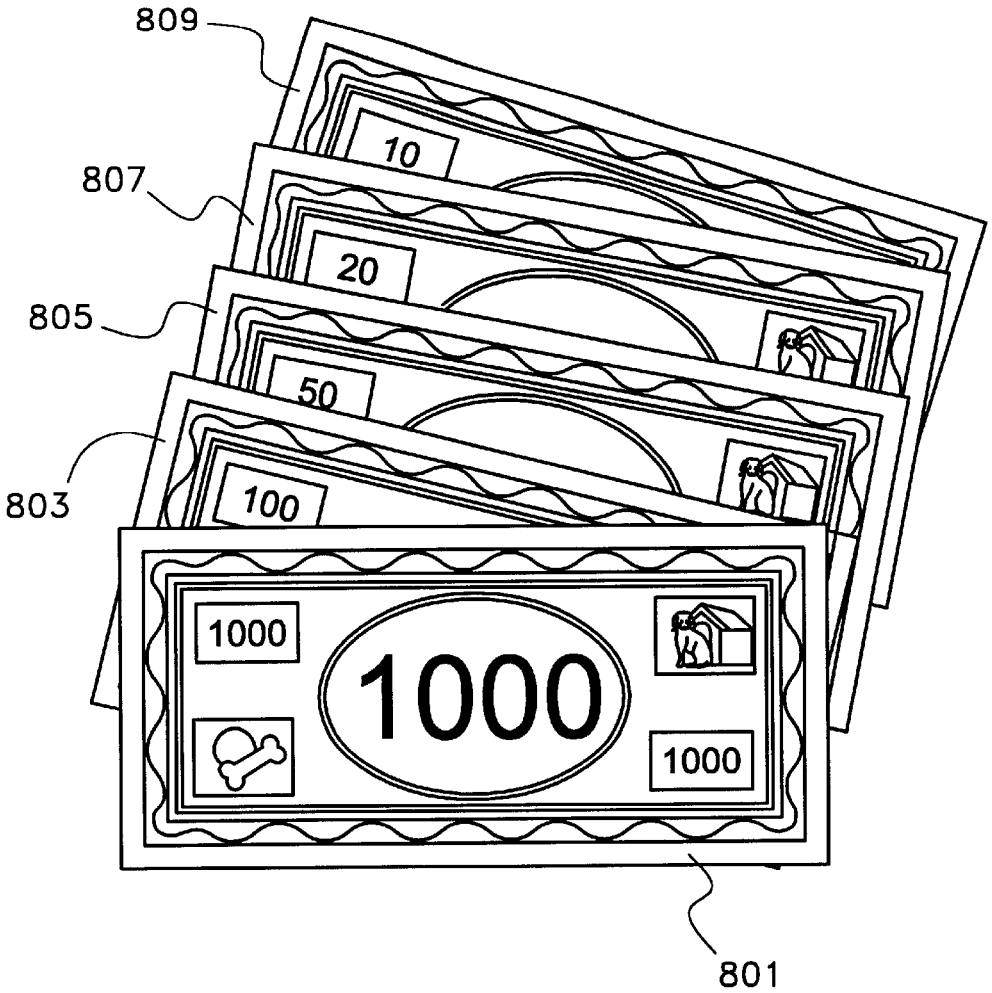
FIG. 8 illustrates play money and FIG. 9 shows a top view of a bone-shaped play money holder which may be used in the present invention.

FIG. 8 shows play money 801, 803, 805, 807, 809, which should be in sufficient supply so as not to hinder game play when played in accordance with the rules.

Figure 9:
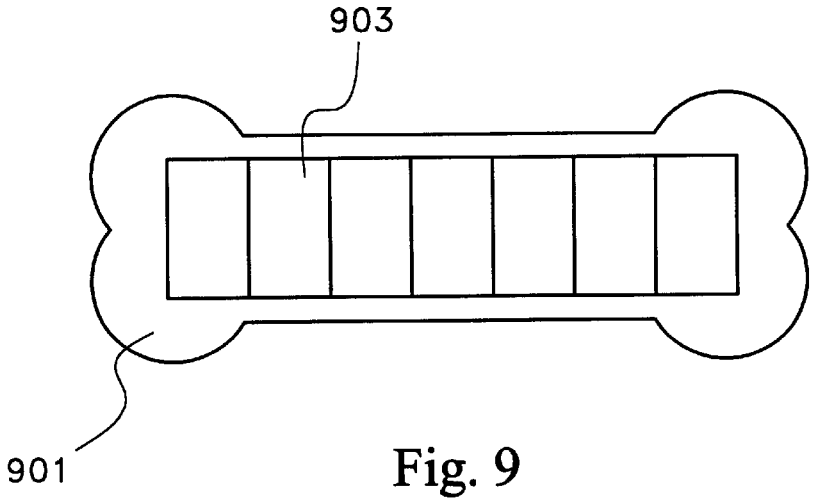

FIG. 9 shows a stylized dog bone tray 901 with compartments such as compartment 903 as an optional feature for holding play money.

Figure 10:
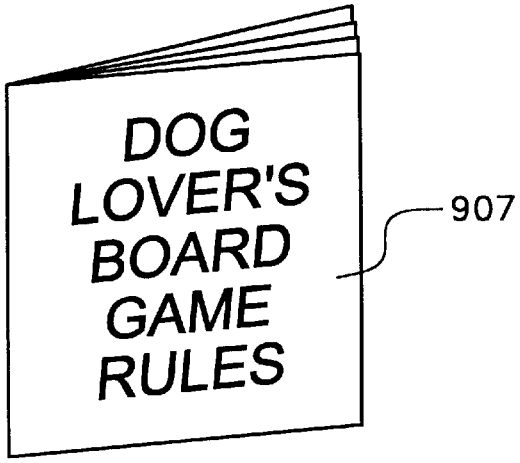
FIG. 10 illustrates a rule book useful in present invention.

FIG. 10 shows dog lover's board game rules 907. The following is an example of rules for a dog lover's game:

EXAMPLE 1

THE GAME OF DOGS

2 TO 4 PLAYERS ages 7 & up

OBJECT: The object of the game is to have more dogs and money than your opponent(s).

EQUIPMENT: The equipment consists of a board, 2 dice, 6 playing pieces, 38 dog houses, 16 condominiums, opportunity and bowl cards, Pedigree papers for each dog, doggie dollars and a breeder's tray.

GET READY TO PLAY: Place the board on a flat surface and place the opportunity and bowl cards on the marked spaces in the center of the board. Each player chooses a playing piece. Each player receives $2500 doggie dollars as follows: 1–1000, 2–500's, 3–100's, 6–20's, 5–10's, 6–5's. All remaining doggie dollars are placed in the breeder's tray.

BREEDER'S DUTIES: Each player throws a single die. The lowest roller becomes the breeder and is the first to start the game. The responsibility of the breeder is to hold all to the pedigree papers and doggie dollars, dog houses and condominiums. The breeder handles all doggie dollar transactions when a player lands on or draws a card that instructs the player to pay or collect doggie dollars.

NOW LET'S PLAY: The breeder starts the game by throwing the dice and moving that many spaces and then following the instructions where they have landed. Play continues to the left. Players can buy any dog they land on as long as nobody else owns it. If a player throws doubles,he or she collects $200 and gets another turn. If doubles are thrown a second time, collect an additional $300 and take another turn.

GO FOR A WALK: Every time a player passes "GO FOR A WALK" collect $200. If a player lands on "GO FOR A WALK" collect $400.

DOG SPA & DOG BOARDING: All doggie dollars paid to these spaces are to be placed in the middle of the board.

TAKE A NAP: If a player lands on this space they collect all doggie dollars in the middle of the board.

GO TO THE VET'S: If a player lands on "GO TO THE VET'S" they do not collect $200 if they pass "GO FOR A WALK". The only ways to get out of the Vet's are: 1) have or purchase a "Get Out of the Vet's" card, 2) roll a 7 or 11 on one of your next three turns or 3) pay each player $100 before your first turn. PLAYERS MAY NOT COLLECT MONEY FROM OTHER PLAYERS WHILE AT THE VET'S.

COLLECTING KENNEL FEES AND BUYING DOG HOUSES & CONDOMINIUMS: Kennel fees and dog house and condominiums prices are listed on all Pedigree papers. A player can begin to collect kennel fees on any dog they own when another player lands on their dog. When a player owns all of the dogs in a color group they can collect additional kennel fees (as noted on the Pedigree papers) when other players land on their dogs. Players can buy dog houses from the breeder once they own all dogs in a color group. Dog houses must be bought for all dogs in a color group evenly. When a player has purchased three dog houses for each dog in a color group they can then upgrade to a dog condominium by paying the condominium fee listed on the Pedigree papers.

SELLING OR TRADING: At any time during the game if your opponent has a dog that you would like you can attempt to buy or trade for it. If a bidding war occurs the owner may choose the player they would like to sell to, they do not have to sell the dog to the highest bidder. If a player experiences financial difficulties they may 1) sell back their dog houses or condominiums for ½ of the original purchase price, 2) sell dogs to their opponents for a fair price (with or without dog houses or condominiums) or 3) sell dogs back to the breeder for paper sale price printed on Pedigree papers (only after buildings have been sold).

HOW DO YOU KNOW WHEN YOU'RE DONE?: You know it's time to drop out of the game when you have no more doggie dollars to pay kennel fees and you have sold off everything. You may not borrow doggie dollars from the breeder or any other players!

GOOD LUCK!

Obviously, numerous modifications and variations of the present invention are possible in light of the above teachings. It is therefore understood that within the scope of the appended claims, the invention may be practiced otherwise than as specifically described herein.

Figure 11:
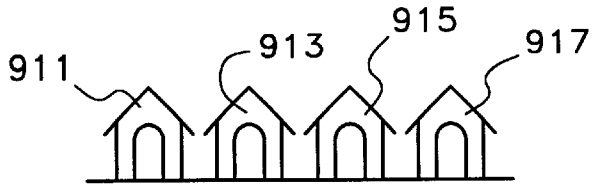
FIG. 11 illustrates a plurality of individual animal housing unit structures and FIG. 12 illustrates a macro-animal housing unit structure useful in the present invention.
Figure 12:
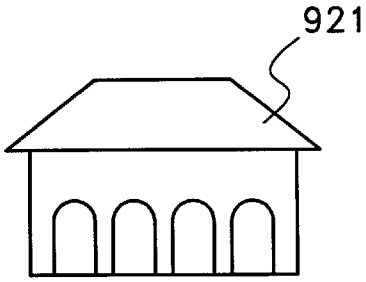

Referring again to the figures, FIGS. 11 and 12 respectively illustrate a set of dog houses 911, 913, 915 and 917, and a dog condo 921. These could be made of molded plastic and be made small enough to rest at the base of a space on a present invention playing board.

Figure 13:
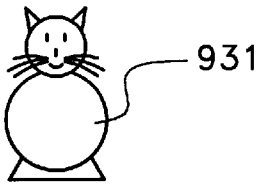
FIGS. 13 and 14 illustrate icon playing pieces which may be useful in the present invention; and, FIG. 15 illustrates a perspective view of a set of dice for random movement means which may be used in the present invention.
Figure 14:
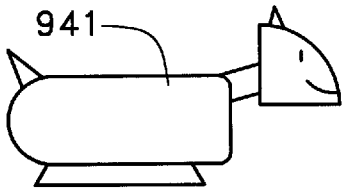

FIGS. 13 and 14 illustrate art deco type cat 931 and dog 941 respectively, which could be used as playing pieces.

Figure 15:
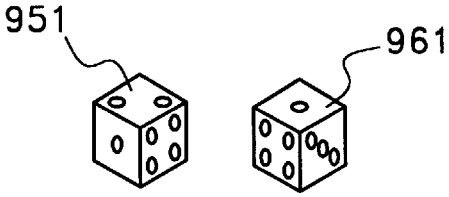

FIG. 15 shows dice 951 and 961 for randomly determining player piece movement in accordance with specified rules. However, any random movement designator could be used such as a spinner, flipping coins, electronic random presentation devices etc.

What is claimed is:

1. A pet lover's board game, which comprises:

(a) a playing board having a predetermined continuous path with spaces for movement of pieces therealong in accordance with rules, said playing board including:

(i) marked breed spaces designating a specified dog, said breed spaces identifying its specified breed by name, pictorial representation or combinations thereof, and having a specified action of a player when a piece lands thereon;

(ii) marked action spaces, each designated so as to require a specified action of a player when a piece lands thereon wherein said marked action spaces are disparate corner spaces on said playing board and wherein at least one said corner marked action space is labeled "Take A Nap" wherein a player must skip exactly one turn before resuming playing after landing thereon after collecting accumulated play money from a middle of said board accumulated from payments made on dog spa and dog boarding spaces; and (iii) marked event spaces, each designated so as to represent an event which may initiate a payment or other event of a player when a piece lands thereon;

(b) a random movement means for randomly determining numbers of spaces to be moved by players in accordance with rules;

(c) a set of dog ownership papers for marked breed spaces provided to a player in exchange for payment of play money if a player qualifies to purchase and elects to purchase in accordance with rules;

(d) a set of event cards corresponding to at least one marked event space to be read and acted upon by a player when a piece lands on a corresponding event space;

(e) a plurality of different icon pieces for use by a plurality of players wherein said icon pieces have a topographical shape of a dog;

(f) play money in predetermined denominations;

(g) a play money holding tray having at least one compartment sized and shaped for holding said play money and having a dog bone topographical shape; and (h) rules defining use of the aforesaid by order of play, use of said random movement means, movement of pieces, acquisition of ownership papers, sale of ownership papers, action apace play, event space play, use of event cards, payments of landing fees, and how games may be won or lost.

2. The pet lover's board game of claim 1 wherein said playing board is rectangular.

3. The pet lover's board game of claim 2 wherein said event spaces include at least one event space requiring a player to take an event card and act upon it when that player's piece lands upon it.

4. The pet lover's board game of claim 1 wherein said event spaces include at least one event space requiring a player to take an event card and act upon it when that player's piece lands upon it.

5. The pet lover's board game of claim 1 wherein there are at least two different event spaces, and two different collections of event cards, and each of said at least two different event spaces require a player to take and act upon an event card from a specific one of said at least two different collections of event cards.

6. The pet lover's board game of claim 5 wherein said at least two different collections of event cards includes opportunity cards and chance cards.

7. The pet lover's board game of claim 1 wherein said board game further comprises:

(i) a plurality of dog housing unit structures available for purchase to players owning marked breed spaces wherein other players having a piece land on a marked breed space with at least one dog housing unit will pay increased landing fees in relationship to the number of dog housing units on that space landed upon.

8. The pet lover's board game of claim 7 wherein said board game further comprises:

(j) a plurality of macro-dog housing unit structures for purchase or conversion, being equal in value to a specified number of dog housing unit structures and requiring a greater landing fee.

9. The pet lover's board game of claim 1 wherein said set of ownership papers are individual cards corresponding to individual marked board spaces and include breed identification, cost of ownership and landing fees.

* * * * *